US005972464A

United States Patent [19]

Pezzuco

[11] Patent Number: 5,972,464

[45] Date of Patent: Oct. 26, 1999

[54] PALLET WRAPPING APPARATUS

[76] Inventor: Kevin O. Pezzuco, 908 Boston Neck Rd., Narragansett, R.I. 02882

[21] Appl. No.: 08/869,008

[22] Filed: Jun. 4, 1997

[51] Int. Cl.[6] ..... B32B 3/06

[52] U.S. Cl. ..... 428/100; 206/386; 206/597

[58] Field of Search ..... 428/100; 206/386, 206/597

[56] References Cited

U.S. PATENT DOCUMENTS

| | | | |
|---|---|---|---|
| 2,696,360 | 12/1954 | Toffolon | 206/597 |
| 3,371,815 | 3/1968 | Macomber | 206/597 X |
| 4,852,330 | 8/1989 | Carangelo | 206/597 X |
| 4,868,955 | 9/1989 | Magnant et al. | 206/597 X |
| 4,876,841 | 10/1989 | Jensen | 206/597 X |
| 5,226,544 | 7/1993 | Gallucci et al. | 206/597 |
| 5,388,702 | 2/1995 | Jones | 206/597 |

*Primary Examiner*—Henry F Epstein
*Attorney, Agent, or Firm*—Barlow, Josephs & Holmes, Ltd.

[57] ABSTRACT

A pallet wrapping apparatus for stabilizing a palletized cluster of articles is provided. The pallet wrapping apparatus includes an elongated panel having alternating non-elastic and elastic panels. The elongated panel is mounted by a hook to the pallet and is wrapped about the cluster of articles and secured in place by VELCRO strips. The use of alternating non-elastic and elastic panels enables the pallet wrapping apparatus to closely simulate disposable plastic film wrap while still being able to accommodate article cluster stacks of varying sizes and shapes.

4 Claims, 5 Drawing Sheets

PALLET WRAPPING APPARATUS

BACKGROUND OF THE INVENTION

The present invention relates generally to storing and transporting cargo on pallets. More specifically, the present invention relates to a pallet wrapping apparatus for stabilizing cargo on a pallet for storage and transportation.

In the field of cargo storage and transportation, pallets are extensively used for supporting such cargo, which includes goods and containers for goods, in a storage facility such as a warehouse. A common problem associated with this storage and transportation method is the tendency of the palletized materials or cargo to fall off of the pallet during transport. Transport commonly shakes the stacked loads and causes them to collapse which results in damaged merchandise and a danger to persons handling such unstablized stacked goods.

Attempts have been made in the prior all to stabilize palletized articles to prevent the aforementioned problems. Pallet wrappers are used extensively by both commercial and industrial establishments to secure articles on a pallet to facilitate the pallet being transported throughout the establishment and perhaps to the point of display, for example. These pallet wrappers are placed about the stacked articles on the pallet to prevent them from moving and shifting during transport. These pallet wrappers are often used to prevent the cargo from falling off the pallet while being transported on the ground or in a forklift for storage on shelving.

The pallet wrapping apparatuses of the prior art include disposable plastic film from a roll as well as reusable devices which secure about the perimeter of the cargo stack. The disposable plastic film is typically dispensed from a roll and wrapped about the cluster of articles or cargo stacked on the pallet. The plastic film is typically started at the base of the pallet and wrapped up and around the cargo in spiral fashion to stabilize the cargo in place. Since the plastic film is flexible with elastic qualities, irregularly shaped articles can be easily accommodated during wrapping process. Despite the aforementioned advantages, plastic film must be cut away from the cargo when the cargo reaches its destination and cannot be reused resulting in considerable plastic waste.

To combat the excessive waste associated with plastic film wrapping, efforts in the prior art have been made to employ a reusable device for stabilizing a cluster of articles. These devices typically include a flexible and resilient heavy-duty material with some type of fastener connected to the edges of the resilient material. The material, usually in the form of a sheet, is wrapped about the stacked cluster of articles and then secured in place by its connectors. Each of the known reusable pallet wrapping devices of the prior art do not easily accommodate irregularly shaped articles due to the fixed size of the sheet of resilient material which is sized to be substantially equivalent to the perimeter of the article cluster. Thus, in the prior art, the resilient sheeted material is wrapped only one time around the cluster of articles. Therefore, it cannot be easily adapted to article clusters of varying sizes.

Due to the demand for a pallet wrapping apparatus, which does not produce waste and can accommodate a wide array of article cluster sizes and shapes, it is desirable for a pallet wrapping apparatus to be reusable with a configuration and design which is universal to easily accommodate any type of article cluster which is disposed on a pallet. It is also desirable for a pallet wrapping apparatus to closely simulate plastic film wrapping and its ability to accommodate article clusters of different sizes and shapes. It is also desirable that a reusable pallet wrapping apparatus provide superior cluster retention characteristics which are typically only associated with plastic film wrap.

SUMMARY OF THE INVENTION

The present invention preserves the advantages of prior art pallet wrapping apparatuses for stabilizing a cluster of articles. In addition, it provides new advantages not found in currently available pallet wrapping apparatuses and overcomes many disadvantages of such currently available apparatuses.

The invention is generally directed to a novel and unique pallet wrapping apparatus with particular application in stabilizing a cluster of articles residing on a pallet. The pallet wrapping apparatus of the present invention enables the simple, easy and inexpensive wrapping of a cluster of articles on a pallet without the waste associated with disposable plastic film or inflexibility associated with prior art reusable pallet wrapping devices.

The preferred embodiment of the present invention includes an elongated panel of flexible material having a first end and a second end with an inner side and an outer side. The elongated panel of flexible material has a length which is capable of wrapping around the cluster of articles at least four times. The elongated panel includes alternating panels of elastic and non-elastic material. A hook is provided on one end of the elongated panel for securing the first end of the elongated panel directly to the pallet which is supporting the cluster of articles. A sheet of hook material is attached to the inner side of the elongated panel with the second end of the elongated panel. A sheet of hook material is attached to the outer side of the elongated panel at a distance from the second end of approximately a length equal to the outer perimeter length of the cluster of articles.

In operation, the hook is secured to the pallet to provide a mount. The pallet wrapping apparatus of the present invention is then wrapped about the perimeter of the cluster of articles in an upwardly spiral manner in similar fashion to wrapping a cluster of articles with disposable plastic film. As the elongated panel is wrapped about the cluster of articles, the installer pulls on the panel as it is installed to thereby tighten the entire cluster. After four or five turns around the cluster of articles, a sheet of hook material on the inner side of the elongated panel is placed in communication with the sheet of loop material attached on the outer side of the elongated panel to secure the second end of the elongated panel in place at the top of the cluster of articles. As a result, the cluster of articles are not only stabilized with respect to each other but also firmly secured to the pallet thereunder.

It is therefore an object of the present invention to provide a pallet wrapping apparatus which can be reusable to avoid the excessive waste associated with disposable plastic film wrap.

Another object of the present invention is to provide a pallet wrapping apparatus which can closely simulate the characteristics of plastic film wrap.

It is a further object of the present invention to provide a pallet wrapping apparatus which can accommodate article clusters of varying sizes and shapes.

It is yet a further object of the present invention to provide a pallet wrapping apparatus which is self-tightening and self-customizing during installation.

BRIEF DESCRIPTION OF THE DRAWINGS

The novel features which are characteristic of the present invention are set forth in the appended claims. However, the inventions preferred embodiments, together with further objects and attendant advantages, will be best understood by reference to the following detailed description taken in connection with the accompanying drawings in which:

DETAILED DESCRIPTION OF THE PREFERRED EMBODIMENT

Figure 1:
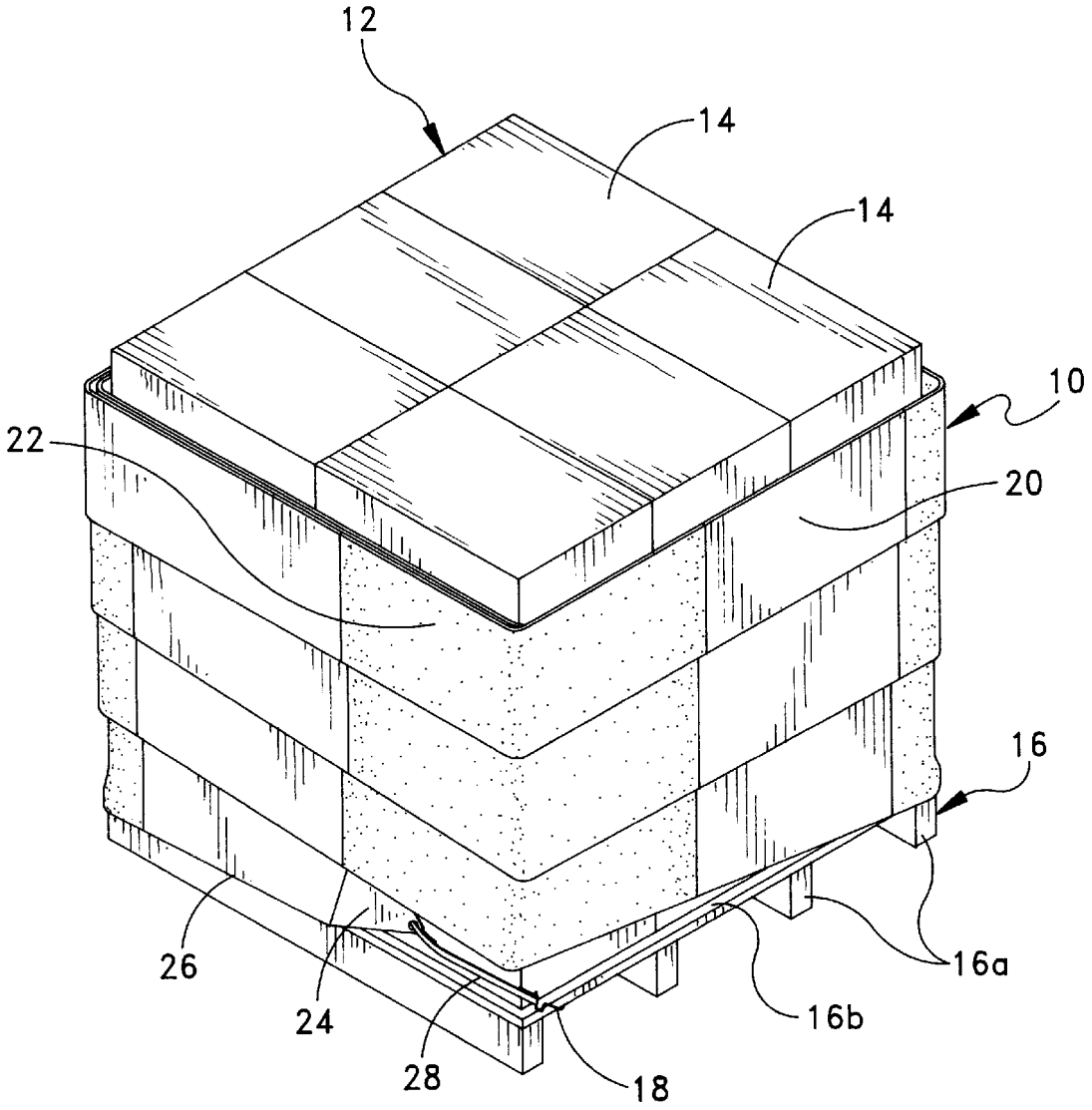
FIG. 1 is a perspective view of the pallet wrapping apparatus of the present invention installed on a cluster of articles residing on a pallet.

Referring to FIG. 1, a perspective view of the pallet wrapping apparatus 10 of the present invention is generally shown installed about a cluster 12 of articles 14 residing on pallet top surface 16*b* of pallet 16 having legs 16*a*. In general, pallet wrapping apparatus 10 is secured to pallet 16 by hook 18 via connection panel 24 and connector strip 28. As will be described in detail below, pallet wrapping apparatus 10 includes a number of non-elastic panels 20 and elastic panels 22. Pallet wrapping apparatus 10 is wrapped about article cluster 12 in an upwardly spiral fashion and secured in place.

Figure 2:
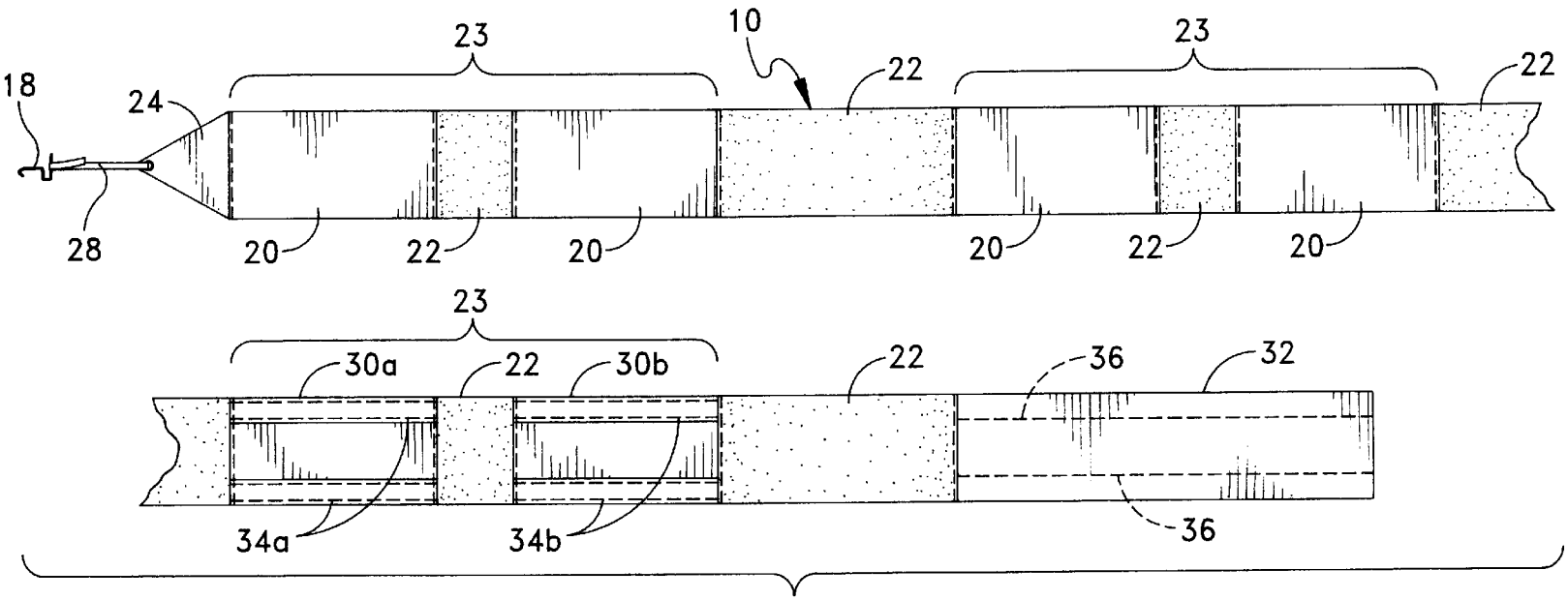
FIG. 2 is a plan view of the pallet wrapping apparatus of the present invention.
Figure 3:
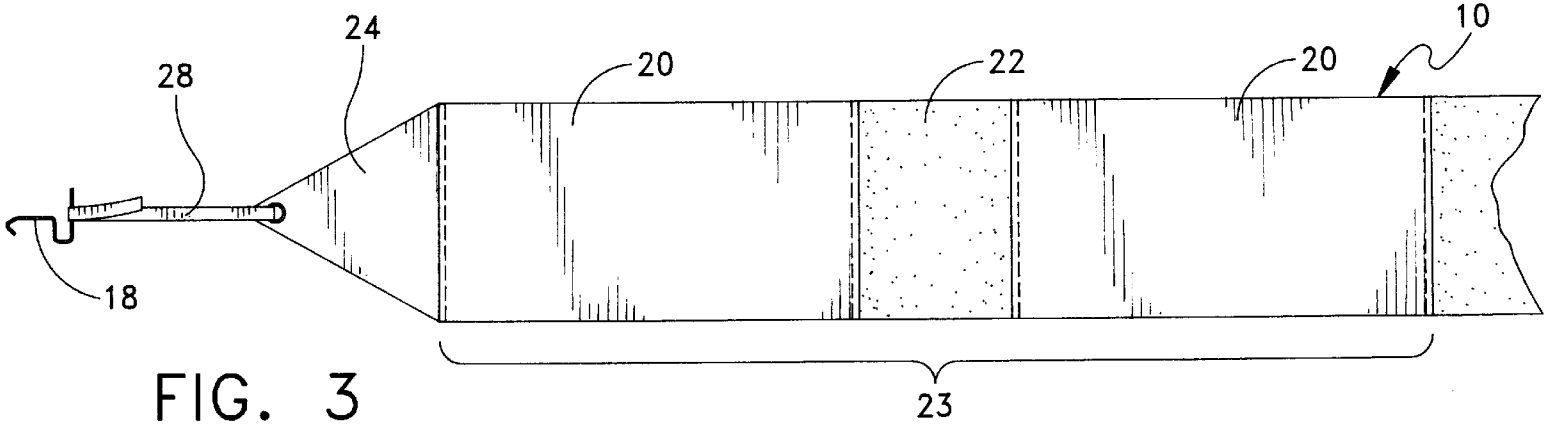
FIG. 3 is a close-up plan view of the hook end of the apparatus shown in FIG. 2.

Referring now to FIGS. 2–5, the specific preferred construction of the pallet wrapping apparatus 10 of the present invention is shown. As shown in FIGS. 2 and 3, pallet wrapping apparatus 10 includes a securing hook 18 attached to connector strip 28 which is, in turn, attached to connection panel 24 which is preferably sewn directly to a non-elastic panel 20 which is preferably made of a rip and tear-proof vinyl coated nylon. Sewn directly to non-elastic panel 20 is elastic panel 22 which is preferably heavy gauge nylon elastic. An additional non-elastic panel 20 is attached directly to elastic panel 22 to provide a first split elastic panel generally referred to as 23. In this split elastic panel 23, it is preferred that the two non-elastic panels 20 be twenty-eight inches long and the center elastic panel 22 be ten inches long. All panels within the pallet wrapping apparatus 10 is preferably in the range of 16 to 18 inches wide. After the first split elastic panel 23, another elastic panel 22 is provided of, preferably, thirty inches long. Thereafter, another split elastic panel 23 including both elastic panel 22 and non-elastic panels 20 are provided. This pattern repeats as desired to attain the preferred overall pallet wrapping apparatus length. FIG. 2 is broken to represent such repetition.

Figure 4:
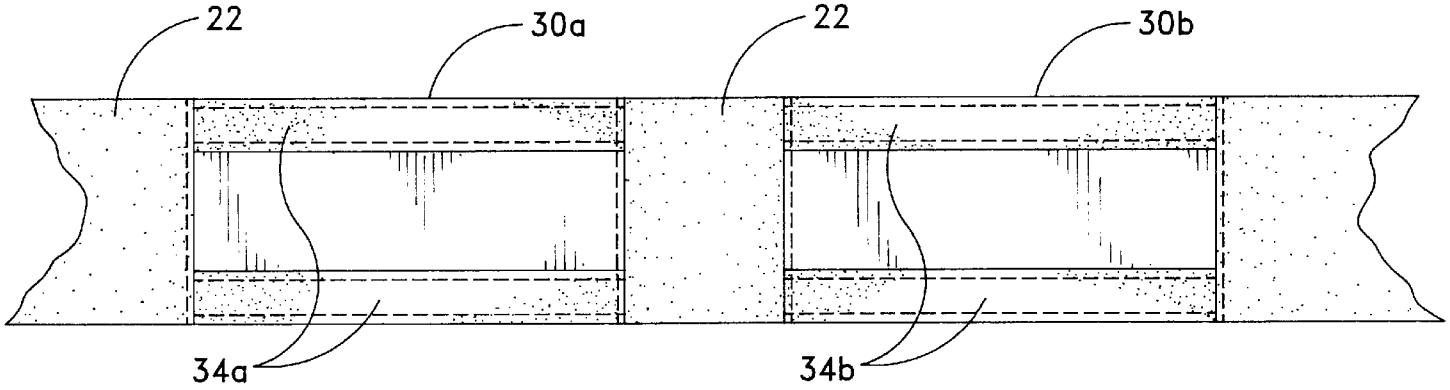
FIG. 4 is a close-up plan view of the outer side securing panel portion of the apparatus shown in FIG. 2.
Figure 5:
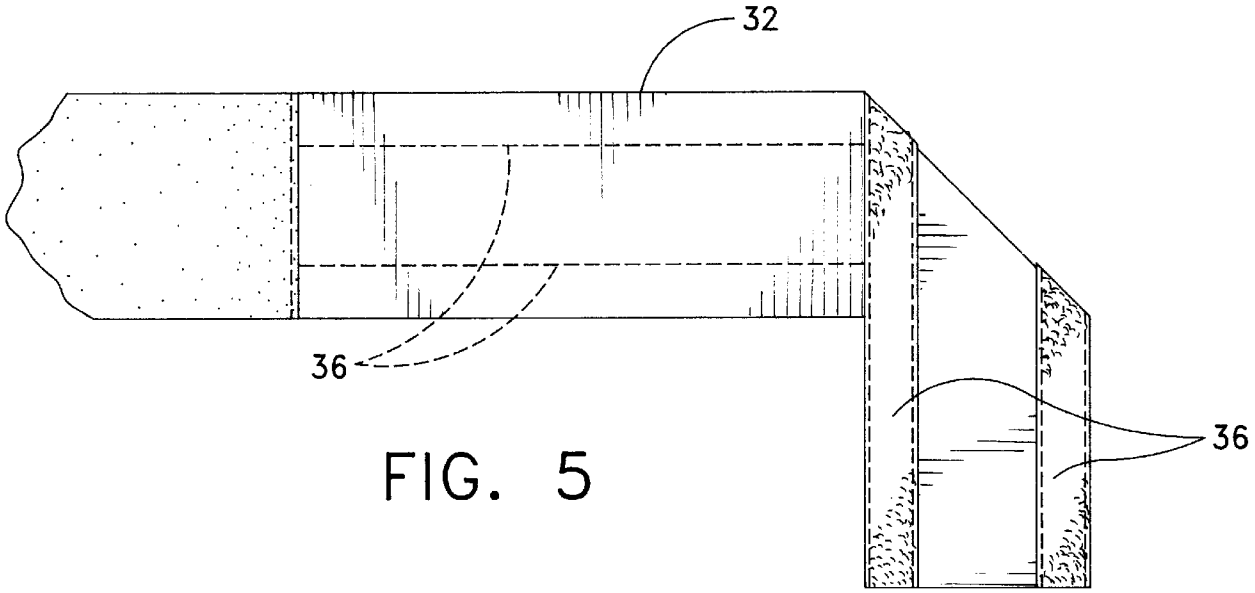
FIG. 5 is a close-up plan view of the inner side securing panel end of the apparatus shown in FIG. 2.

On the bottom half of FIG. 2, split elastic panel 23 includes hook fastening material strips 34*a* and 34*b* where the non-elastic panels 20 are now referenced as outer side securing panels 30*a* and 30*b*. Still referring to the lower half of FIG. 2, an elastic panel 22 is provided after split panel 23 for connection to inner side securing panel 32 with loop fastening material strips 36 on the opposing side as the hook fastening material strips 34*a* and 34*b*. FIG. 4 illustrates a close-up view of outer side securing panels 30*a* and 30*b* which carry hook fastening strips 34*a* and 34*b*. In addition, FIG. 5 illustrates inner side securing panel 32 with loop fastening material strips 36 thereon. Hook fastening material strips 34*a* and 34*b* and loop fastening material strips 36 are preferably VELCRO material in an elongated strip form but may be larger sheets of fastening material depending on the desired application.

As will be discussed in detail below in connection with the installation of the pallet wrapping apparatus 10, loop fastening material strips 36 communicate with hook fastening material strips 34*a* and 34*b* to secure the pallet wrapping apparatus 10 in place. The above dimensions and length of split elastic panel 23 and non-elastic panel 20 and elastic panel 22 may be modified to accommodate a particular pallet application. For example, the width of the pallet wrapping apparatus 10 may be modified to accommodate smaller-sized pallets and article clusters thereon. In addition, hook 18 may be connected directly to the first non-elastic panel without the need for connection panel 24 or connector strip 28.

Figure 6:
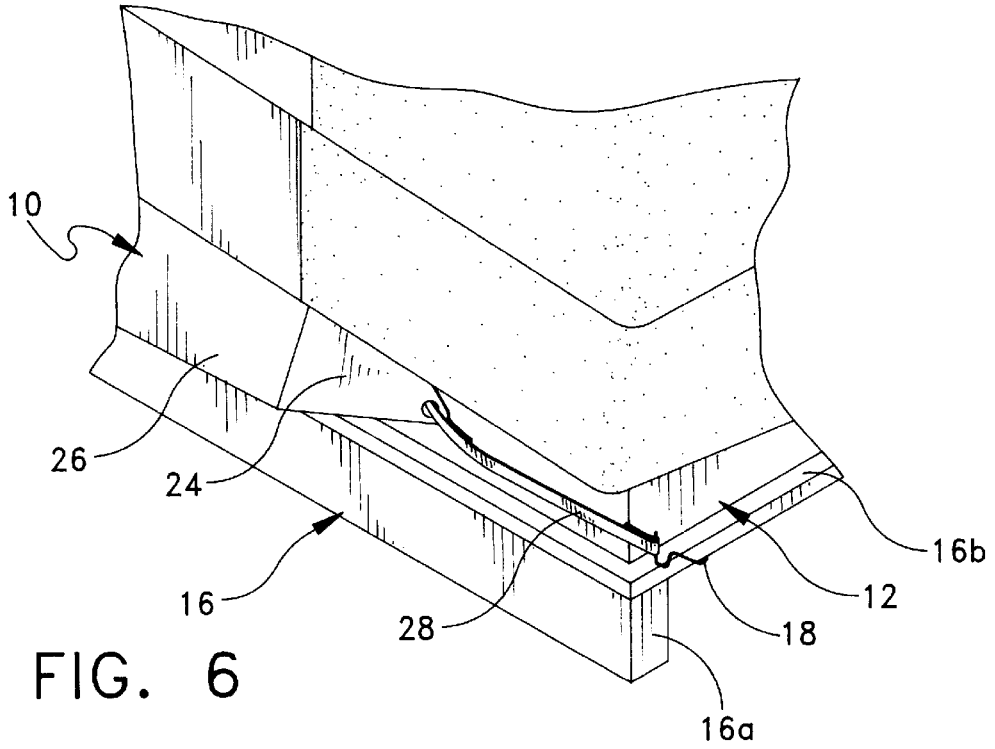
FIG. 6 is a close-up perspective view of the hook mount in accordance with the present invention.
Figure 7:
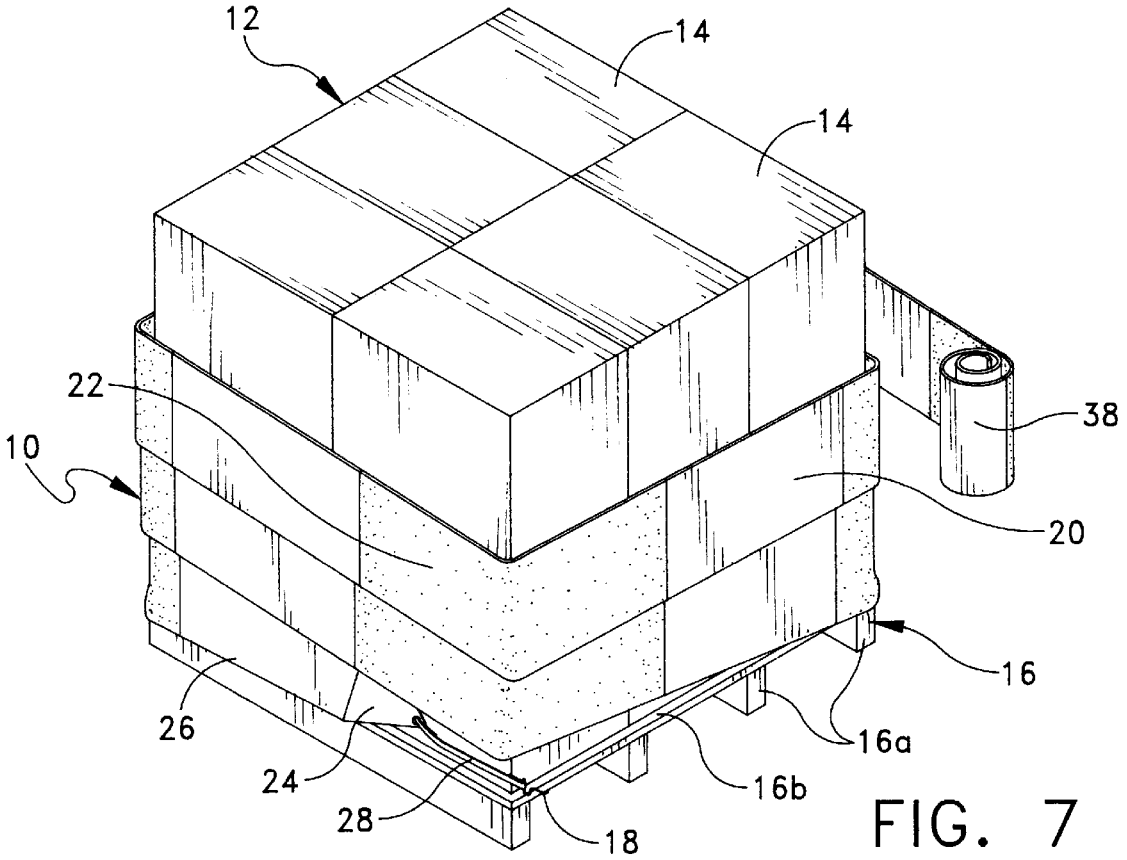
FIG. 7 is a perspective view illustrating the upward spiral installation of the pallet wrapping apparatus of the present invention.
Figure 8:
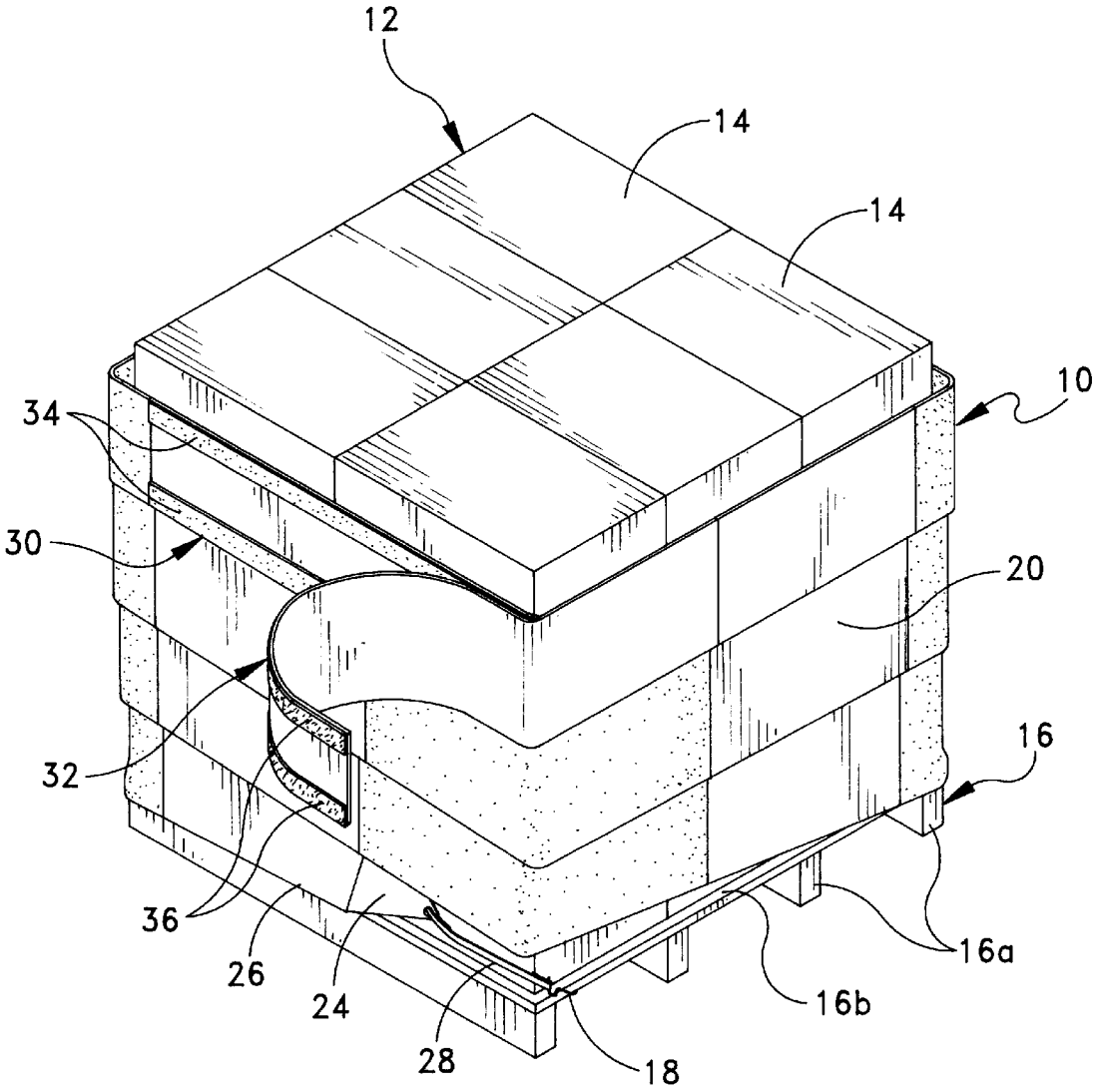
FIG. 8 is a perspective view of securing the free end of the pallet wrapping apparatus to complete the installation of the pallet wrapping apparatus in accordance with the present invention.

Turning now to FIGS. 6–8, the installation of the pallet wrapping apparatus 10 of the present invention on a cluster of articles 12 on a pallet 16 is shown. Referring now to FIG. 6, hook 18 is secured to pallet 16, for example, directly under the top surface 16*b*. Alternatively, hook 18 may be secured to pallet leg 16*a*. Pallet wrapping apparatus 10 is then preferably wrapped in a clockwise fashion about the cluster 12 with the lower panel edge 26 overlapping and embracing pallet 16 so that articles 14 will not only be secured relative to each other in a cluster 12 but also secured to pallet 16. As a result, cluster 12 will not move relative to pallet 16.

Referring now to FIG. 7, pallet wrapping apparatus 10 is wrapped about the perimeter of cluster 12 and is pulled as it is wound spirally upward from roll 38. The use of split panel 23 enables pallet wrapping apparatus 10 to closely simulate disposable plastic film wrap of the prior art. The use of elastic panels 22 interdisposed between non-elastic panels 20 enable the installer to continually tighten and group the articles 14 together while spiraling upward. Elastic panels 22 provide the elastic retention of articles 14 while non-elastic panels provide a more rigid structure for actually retaining the articles in place. As a result, the unique combination of alternating elastic panels 22 and non-elastic panels 20 enables the pallet wrapping apparatus 10 to closely simulate plastic film wrap while still being able to accommodate a wide range of article cluster sizes and shapes.

In similar fashion to disposable plastic film wrap, pallet wrapping apparatus 10 is preferably wrapped four to five times. Depending on the size of the article cluster 12, only two or three wraps may be needed or as many as seven or eight. Such variations of wrapping are still considered within the scope of the invention. Since a pallet is typically four feet by four feet and articles 14 are commonly stacked six feet high, the pattern of split elastic panels 23 and elastic only panels of thirty inches would be repeated to enable four or five turns with the inner side securing panel 32 being fifty-six inches in length.

As shown in FIG. 8, inner side securing panel 32 is wrapped a final time so it may be placed proximal to either one or both of outer side securing panel 30*a* and 30*b* so that respective loop fastening material strips 36 and hook fastening materials 34*a* and 34*b* may be secured to one another. Due to the overall length and positioning of outer side securing panels 30*a* and 30*b* and inner side securing panel 32, there is considerable leeway in accommodating article cluster 12 of various sizes and shapes. Since the overlap of hook fastening material 34*a*, 34*b* with loop fastening material 36 is large, even substantial changes in the perimeter size of cluster 12 will not prevent inside securing panel 32 to be secured in place to properly terminate the installation of the pallet wrapping apparatus 10.

Upon arrival of an article cluster 12, which has been stabilized in accordance with the present invention, pallet wrapping apparatus 10 can be easily removed in reverse fashion as to the installation process described above. Inner side securing panel 32 is separated from outer side securing panels 30*a* and/or 30*b* and is unwrapped in counter-clockwise fashion, preferably rolling while removing to facilitate the next installation.

It would be appreciated by those skilled in the art that various changes and modifications can be made to the illustrated embodiments without departing from the spirit of the present invention. All such modifications and changes are intended to be covered by the appended claims.

What is claimed is:

1. A pallet wrapping apparatus for stabilizing a cluster of articles on a pallet having defining a cluster outer perimeter length, comprising:

an elongated panel of flexible material having a first end and a second end with an inner side and an outer side; said elongated panel of flexible material having a length greater than said cluster outer perimeter; said elongated panel of flexible material including alternating panels of elastic material and non-elastic material and having a length capable of wrapping around a cluster of articles on a pallet at least two times;

hook means connected to said first end of said elongated panel for securing said first end of said elongated panel directly to said pallet;

a securing member attached to said inner side of said elongated panel proximal to said second end; said securing member being hook fastening material;

a complimentary securing member attached to said outer side of said elongated panel at a distance from said second end of approximately a length equal to said outer perimeter length; said complimentary securing member being loop fastening material; and whereby said hook means is secured to said pallet to provide a mount to permit said elongated panel of flexible material to be wrapped a plurality of times in an upward spiral fashion about said cluster of articles with said inner side of said elongated panel of flexible material being substantially in contact with said outer side of said elongated panel of flexible material and said cluster of articles thereby providing said securing member into securable communication with said complimentary securing member to stabilize said cluster of articles on said pallet.

2. The pallet wrapping apparatus of claim 1, wherein said elongated panel of flexible material is vinyl coated nylon.

3. The pallet wrapping apparatus of claim 1, wherein said elastic material is elasticized nylon.

4. The pallet wrapping apparatus of claim 1, wherein said non-elastic material is vinyl coated nylon.

* * * * *